United States Patent [19]

Drucker

[11] Patent Number: 5,038,579

[45] Date of Patent: Aug. 13, 1991

[54] DUAL FLOW VARIABLE AREA EXPANSION DEVICE FOR HEAT PUMP SYSTEM

[75] Inventor: Alan S. Drucker, DeWitt, N.Y.

[73] Assignee: Carrier Corporation, Syracuse, N.Y.

[21] Appl. No.: 545,173

[22] Filed: Jun. 28, 1990

[51] Int. Cl.[5] ..... F25B 13/00

[52] U.S. Cl. ..... 62/324.6; 62/324.1; 62/222; 62/528; 137/493.9

[58] Field of Search ..... 62/324.6, 324.1, 222, 62/528; 137/493.9

[56] References Cited

U.S. PATENT DOCUMENTS 4,341,090 7/1982 Ramakrishnan ..... 62/324.6

*Primary Examiner*—Albert J. Makay
*Assistant Examiner*—John Sollecito

[57] ABSTRACT

A flow metering device for use as an expansion valve in a heat pump system includes a body having a flow passage extending therethrough. Two pistons are moveably disposed within the flow passage. Each piston has a flow metering port extending therethrough and a bypass flow means associated therewith. A refrigerant metering rod is fixed within the flow passage and extends through both metering ports. The rod has two flow metering configurations formed thereupon, each of which cooperates with one of the pistons to define a variable area flow passage within the valve. The pistons are spring biased to closed positions when there is no flow through the valve. Flow in one direction results in metering through the variable area passage defined by one piston and its associated flow configuration and free flow through the bypass means of the other piston. Flow through the valve in the opposite direction reverses the roles of the pistons.

7 Claims, 3 Drawing Sheets

DUAL FLOW VARIABLE AREA EXPANSION DEVICE FOR HEAT PUMP SYSTEM

BACKGROUND OF THE INVENTION

1. Field of the Invention

This invention relates in general to refrigerant expansion devices for use in thermodynamically reversible compression refrigeration systems having heating and cooling modes of operation. More specifically, this invention relates to a single mechanical expansion device that is capable of operating as a variable area expansion device for both the heating and cooling modes of such a system.

2. Description of the Prior Art

A compression refrigeration system comprises a compressor, a condenser, an expansion device and an evaporator connected in a closed circuit to provide refrigeration. Hot compressed refrigerant vapor from the compressor enters the condenser, where it transfers heat to an external heat exchange medium and condenses. Liquid refrigerant, at a high pressure, flows through the expansion device, where the refrigerant undergoes a pressure drop and at least partially flashes to a vapor. The liquid-vapor mixture then flows through the evaporator where it evaporates and absorbs heat from the external surroundings. The low pressure refrigerant vapor then returns to the compressor to complete the circuit. It has long been recognized that the energy rejected from a refrigeration cycle during condensation may be used to provide heating. Such a system where the flow of refrigerant through the heat exchangers is reversed is commonly referred to as a heat pump.

Typically, to convert the cooling cycle to a heating cycle the duty of the two heat exchangers is thermodynamically reversed. To achieve this result, the direction of refrigerant flow through the system is reversed by changing the connection between the suction and the discharge side of the compressor and the two heat exchangers. This is accomplished for example, by positioning a four-way valve which interconnects the heat exchangers with the inlet and outlet to the compressor. The cooling condenser then functions as an evaporator, while the cooling evaporator serves as a heating condenser. To complete the thermodynamic reversal, the refrigerant must be throttled in the opposite direction between the heat exchangers. Reversible refrigerant cycles have typically used a capillary tube or a double expansion valve and by-pass system positioned in the supply line connecting the two heat exchangers to accomplish throttling in either direction.

Capillary tubes impose serious limitations upon the operational range of a heat pump system in which they are used and accordingly are not frequently employed.

In the double expansion valve arrangement, two opposed expansion valves are positioned in the refrigerant supply line extending between the two heat exchangers. A valve operated by-pass is also positioned parallel to each expansion valve. When the refrigeration cycle is reversed, the by-pass valves are actuated to alternatively utilize one expansion device and by-pass the other.

Commonly assigned U.S. Pat. No. 3,992,898 entitled "Movable Expansion Valve" and issued on Nov. 23, 1976, in the name of Duell, et. al. discloses one approach to eliminating the two expansion valve/two bypass valve arrangement is an expansion device wherein the refrigerant metering port is formed in a free floating piston which is mounted within a chamber. When refrigerant flows through this device in one direction, the free floating piston moves to one position wherein the refrigerant flow is through the metering port thereby serving as an expansion device. When refrigerant flows through this device in the opposite direction, the free floating piston moves to a second position wherein refrigerant is allowed to flow through a number of flow channels formed in the outer peripheral surface of the piston to thereby allow substantially unrestricted flow through the device. This arrangement allows such a device to be used, in combination with a second expansion device of the same design, in a heat pump system to allow the desired expansion of the refrigerant through the system flowing in both the cooling and heating directions. One device is located adjacent to the indoor coil for the cooling mode of operation while the second device is located near the outdoor coil for the heating mode of operation.

In each of the above-described heat pump systems, the system includes two expansion devices, one being dedicated to the cooling mode of operation and the other to the heating mode of operation. Further, each of the expansion devices is of the fixed orifice type wherein a single fixed orifice is selected for each mode of operation which represents a compromise orifice for the wide range of operating conditions which the system may see in each of the modes of operation.

One way of obtaining variable control of the expansion orifice is the use of thermostatic expansion valves. A thermostatic expansion valve controls the flow rate of liquid refrigerant entering the coil serving as an evaporator as a function of the temperature and pressure of the refrigerant gas leaving the evaporator. While being highly efficient in their operation and readily responsive to changes in load upon the system to vary the flow of refrigerant to the evaporator, thermostatic expansion valves are also complicated and expensive. Further, in split system type air conditioning and heat pump systems, where the compressor and condenser are located outside at a remote location from the evaporator, the distance of the sensing bulb from the compressor results in less than optimum conditions in such systems.

It has been recognized that the need exists for a refrigerant expansion device which is inexpensive to manufacture and which is effective in performance over a wide range of operating conditions. One approach to solving this problem has been a refrigerant flow metering device which has a flow metering passage which varies in cross-section in response to changes between the high and low side pressures in the refrigeration system. One such device is described in commonly assigned U.S. Pat. No. 3,659,433 entitled "Refrigeration System Including a Flow Metering Device" issued on May 2, 1972 in the name of David N. Shaw.

One device which provides such a response is a flow metering valve which has a housing with a flow passage in which is mounted a movable piston having a flow metering port extending therethrough. An elongated member within the housing extends into the metering port of the piston. The elongated member and the metering port cooperate to define a flow metering passage between them. The elongated member is configured such that the cross-sectional area varies in relation to the position of the elongated member to the flow metering port. Means are provided for supporting the elongated member within the housing and for controlling the axial position of the elongated member and the piston with respect to one another as a function of the differential pressure across the flow metering piston.

As discussed above in connection with the '898 patent, it is common practice to use two expansion devices in a heat pump system, one dedicated to the cooling mode of operation and the other dedicated to the heating mode.

It has long been an objective to provide a single expansion valve which is capable of providing the expansion function in both the cooling and heating modes of operation of a heat pump system. One approach has been a dual flow electronic expansion valve. One such valve is disclosed in U.S. Pat. No. 4,548,047 entitled "Expansion Valve" issued on Oct. 22, 1985 to Hayashi, et al. This patent describes an expansion valve which has the ability to allow reversible flow of the refrigerant to take place. Typically such valves allows control of the flow rate of the refrigerant regardless of the direction of flow of the refrigerant, so that control may be effected both in the cooling and heating modes by using a single valve. In such devices, typically, input signals are generated by a complex electronic control system which are in turn applied to an electromagnetic coil which controls a plunger which in turn actuates a valve.

Another electronically controlled expansion valve is shown in U.S Pat. No. 4,686,835 entitled "Pulse Controlled Solenoid Valve With Low Ambient Start-up Means", issued on Aug. 18, 1987 to Alsenz. Electronically actuated solenoid flow control valves of the type disclosed in these patents require programmed multiprocessor control systems which are extremely expensive. As a result, such control devices are economically attractive in only the most expensive air conditioning-/heat pump systems.

The need accordingly exists for a simple, inexpensive, single expansion device that is capable of efficiently controlling a heat pump system in both the heating and cooling modes of operation.

SUMMARY OF THE INVENTION

An object of the present invention is a mechanical refrigerant expansion device which is capable of metering the flow of refrigerant therethrough in either direction.

It is another object of the present invention to meter the flow of refrigerant in a refrigerant expansion device in one direction therethrough through a first orifice which varies in size as a function of the pressure differential between the high and low pressure sides of a refrigeration system, and through a second orifice which also varies in size as a function of system pressure differential in the other direction therethrough.

It is a further object of the invention to provide a mechanical refrigerant expansion device which is capable of metering the flow of refrigerant for the cooling mode of operation in one direction therethrough and for the heating mode of operation in the other direction.

It is a related object of the present invention to achieve these and other objects with a simple, safe, low cost, reliable expansion device.

These and other objects of the present invention are achieved by an expansion valve for use in a heat pump system which includes a body having a flow passage therethrough for passing the flow of refrigerant in either direction. Means are provided within the body for metering the flow of refrigerant through the valve in one direction through a first orifice that varies in cross sectional area as a function of the pressure differential across the valve. The means that defines the first orifice also includes means for allowing substantially unrestricted flow through the valve when refrigerant is flowing through the valve in the other direction. Means are also provided within the flow passage for metering the flow of refrigerant through the valve in the other direction through an orifice that varies in cross sectional area as a function of the pressure differential across the valve. Means are provided in the means containing the second orifice for allowing substantially unrestricted flow through the device when refrigerant is flowing through the valve in the direction that the first orifice meters refrigerant.

BRIEF DESCRIPTION OF THE DRAWINGS

The novel features that are considered characteristic of the invention are set forth with particularity in the appended claims. The invention itself, however, both as to its organization and its method of operation, together with additional objects and advantages thereof, will best be understood from the following description of the preferred embodiment when read in connection with the accompanying drawings wherein like numbers have been employed in the different figures to denote the same parts, and wherein:

DESCRIPTION OF THE PREFERRED EMBODIMENTS

Figure 1:
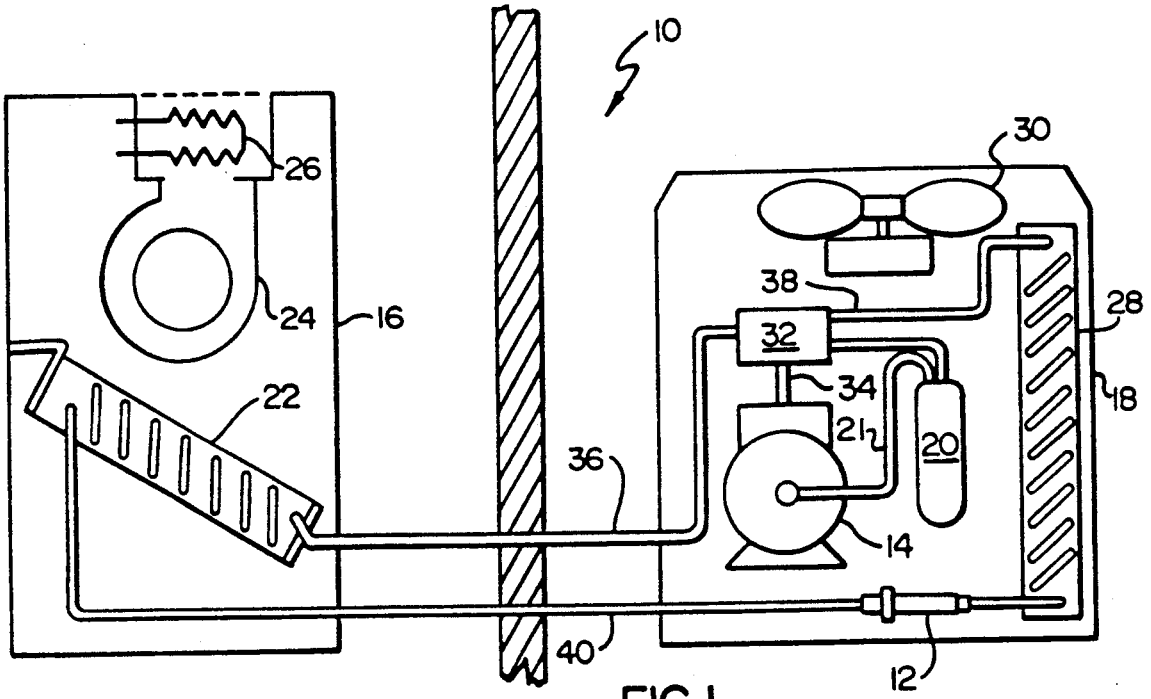
FIG. 1 is a schematic diagram of a heat pump system making use of an expansion device according to the present invention.

With reference first to FIG. 1, numeral 10 designates a heat pump of substantially conventional design, but having a mechanical dual flow variable area expansion valve 12 according to the present invention. The dual flow variable area expansion valve replaces the multiple expansion devices and check valves and/or the electronically controlled dual flow expansion valves found in the refrigerant line between the heat exchangers of many prior art heat pumps. The operation of the dual flow variable area expansion valve will be described more fully hereinafter.

The heat pump 10 also includes a compressor 14, an indoor heat exchanger assembly 16 and an outdoor heat exchanger assembly 18. An accumulator 20 is shown in the compressor suction line 21, however, it is contemplated that, because of the location of the expansion valve 12, and because of the variable metering capability of the valve, the accumulator may not be needed in a system employing the present invention.

The indoor heat exchange assembly 16 includes a refrigerant-to-air heat exchange coil 22 and an indoor fan 24. The indoor assembly is also shown with a backup electrical resistance heating coil 26. The outdoor heat exchanger assembly 18 includes a refrigerant-to-air heat exchange coil 28 and an outdoor fan 30. The indoor and outdoor heat exchanger assemblies are of conventional design and will not be described further herein.

A four-way reversing valve 32 is connected to the compressor discharge port by a refrigerant line 34, to the compressor suction port by suction line 21 and to coils 22 and 28 by refrigerant lines 36 and 38, respectively. The reversing valve 32 is also of conventional design for directing high pressure refrigerant vapor from the compressor to either the indoor coil 22, in the heating mode of operation or, during the cooling mode and defrost, to the outdoor coil 28. Regardless of the mode of operation, the reversing valve serves to return refrigerant from the coil which is operating as an evaporator to the compressor.

A refrigerant line 40 interconnects the indoor heat exchanger coil 22 and the outdoor heat exchanger coil 28. The dual flow variable area expansion valve 12 according to the present invention, is located in the line 40 within the outdoor heat exchange assembly housing 18, adjacent to the outdoor coil 28. Two embodiments of the dual flow variable area expansion valve 12 will now be described in detail followed by a description of the operation of both embodiments in the cooling and heating modes of operation and a description of the operational advantages of a system which is equipped with either embodiment of the valve.

Figure 2:
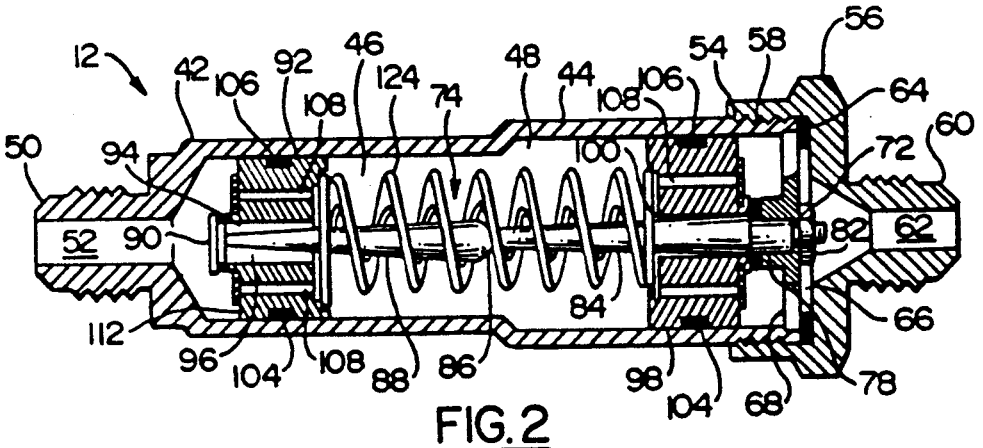
FIG. 2 is a longitudinal sectional view through an expansion device according to one embodiment of the present invention.
Figure 3:
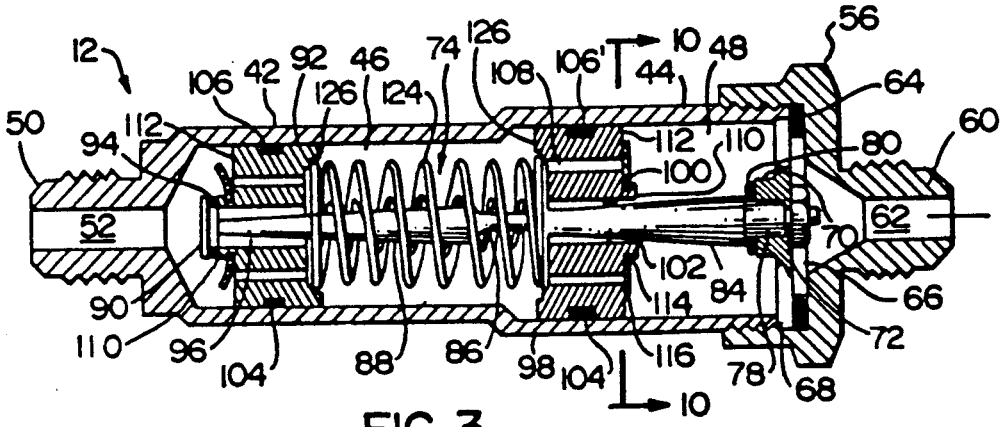
FIG. 3 is a longitudinal sectional view through the expansion device of FIG. 2 showing operation of the device while in the heating mode of operation.
Figure 4:
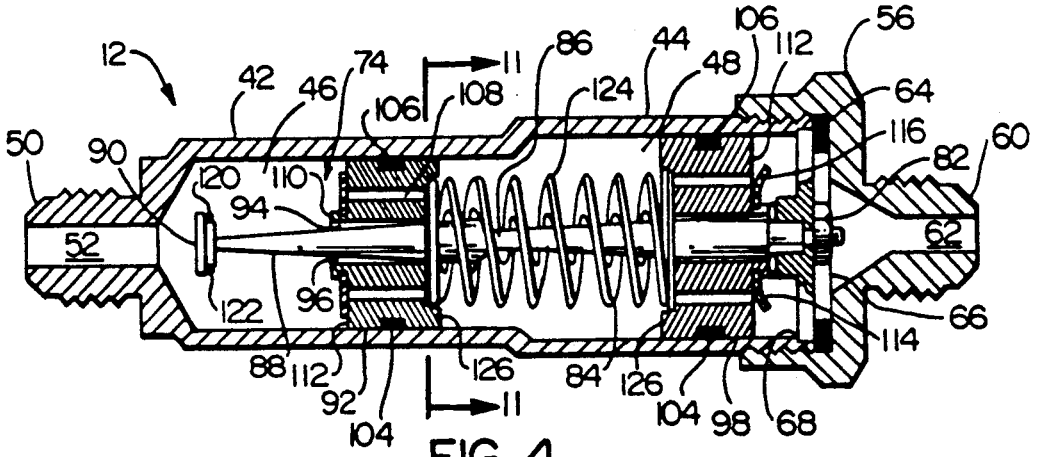
FIG. 4 is a longitudinal sectional view through the expansion device of FIG. 2 showing operation of the device while in the cooling mode of operation.

Looking first at FIGS. 2–4 a first dual flow variable area expansion valve 12 comprises a generally cylindrical body having a first smaller diameter section 42 forming the left hand end thereof and a larger diameter section 44 forming the right hand end thereof. The two cylindrical body sections 42 and 44 cooperate to define a cylindrical elongated chamber in the interior thereof which includes a region of smaller diameter 46 and a region of larger diameter 48 associated with the body portions 42 and 44 respectively. The left hand part of the body 42 and the chamber 46 defined therein will be referred to hereinafter as the cooling body portion and chamber. Likewise, the right hand body portion 44 and the chamber 48 defined therein will be referred to as the heating body portion and chamber.

Extending from the left hand end of the cooling portion of the body 42 is a threaded nipple 50 having a fluid passageway 52 formed therein which communicates the interior chamber 46 with the exterior thereof. The right hand end of the body portion 44 is open-ended and has a male thread 54 formed on the exterior thereof. The open end of the body portion 44 is closed by an end cap 56 which has interior threads 58 which mate with the threads 54 on the body. A nipple 60, having a fluid passage way 62 therethrough, extends outwardly from the end cap 56. The fluid passageways 52 and 62 of the nipples 50 and 60, together with the interior chambers 46 and 48 define a flow passage through the expansion device. A circular washer 64 is mounted within the end cap 56 and cooperates with the end of the body 44 to establish a fluid tight seal therebetween.

A four legged cruciform like element, hereinafter referred to as the refrigerant metering rod retainer 66, is supported at the right hand end of the body portion 44 by cooperation between the end cap 56 and an interior groove 68 formed in the interior surface of the open right hand end of the body 44. The metering rod retainer 66 comprises a central hub like portion 70 through which an axially extending opening 72 extends. The opening 72 includes a threaded portion adjacent the right hand end and a larger diameter portion extending through to the left hand end of the hub.

Mounted to the metering rod retainer 66 in a cantilever fashion is a refrigerant metering rod 74. The refrigerant metering rod includes a reduced diameter threaded portion 76 which is adapted to be threadably engaged with the threaded portion of the opening 72 in the metering rod retainer 66. Extending from the left of the threaded end of the rod is an unthreaded portion, having a diameter greater than the threaded end, which defines an O-ring receiving surface 78. Attachment of the refrigerant metering rod 74 to the retainer 66 is a accomplished by first installing an O-ring 80 on the O-ring receiving surface 78, and then, threading the metering rod retainer 66 onto the threaded end 76 until it abuts the enlarged diameter portion 78 supporting the O-ring 80. Following this, a lock nut 82 is threaded onto the end 76 of the rod to securely lock the metering rod to the retainer 66. A lock washer (not shown) may be used to assure a positive connection.

Extending to the left, from its attachment to the metering rod retainer, the metering rod 74 includes a first flow metering configuration 84 which will be referred to as the heating configuration. The heating configuration 84 which extends from a point of maximum cross-section adjacent the O-ring 80 and decreases in cross sectional area to a minimum at a point 86 at approximately the midpoint of the rod 74. From the midpoint 86 the flow metering rod makes a transition to a region of maximum cross-section of a second flow metering configuration 88 which will be referred to as the cooling configuration. The cooling configuration, in turn, decreases in cross-section as it extends to the left where the rod terminates in an enlarged end portion 90.

A flow metering piston 92 dedicated to the cooling mode of operation, is generally cylindrical in shape and has a cooling metering port 94 extending axially, centrally therethrough. The cooling metering port 94 is of such a size that the cooling configuration 88 of the flow metering rod 74 is readily received therein to allow relative axial movement of the cooling piston 92 with respect to the rod. The space defined between the cooling metering port 94 and the cooling configuration 88 of the rod 74 is defined as the cooling variable area flow metering passage 96.

A heating flow metering piston 98 is also generally cylindrical in shape and has a heating metering port 100 extending axially, centrally, therethrough. The heating metering port 100 is of such a size that the heating flow metering configuration 84 of the flow metering rod 74 is readily received therein to allow relative axial movement of the heating piston 98 with respect to that portion of the rod. The spaced defined between the heating flow metering port 100 and the heating configuration 84 of the rod is defined as the heating variable area flow metering passage 102. The interaction between the cooling and heating pistons 92, 98 and the metering rod 74 to vary the area of the cooling and heating variable area flow metering passages 96 and 102 will be described in more detail hereinbelow.

The outside diameter of the cooling piston 92 is of such a dimension that the piston is received within the cylindrical cooling chamber 46 of the body portion 42 with a clearance allowing free axial motion of the piston with respect to the body. An annular groove 104 is machined into the outside of the surface of the piston and a suitably sized O-ring is adapted to be received therein in a manner such that it cooperates with the groove 104 and the inside surface of the chamber 46 to preclude refrigerant flow between these surfaces when the device is in operation in a heat pump system.

The outside diameter of the heating piston 98 is larger than that of the cooling piston so that it is received within the heating chamber 48 of the body portion 44 with a clearance allowing free axial motion with respect to the body. A groove 104, and O-ring 106 arrangement, identical to that described with respect to the cooling piston 92, is provided on the heating piston 98.

Other features of the cooling and heating pistons 92, 98 are substantially identical and will be described only once herein using the same reference numerals for both pistons.

Both pistons 92 and 98 are provided with a plurality of fluid flow bypass openings 108 which extend axially therethrough and which are parallel with the metering ports 94, 100 provided in the pistons 92 and 98 respectively. Each piston 92, 98 also includes a centrally located, reduced diameter boss 110 which extend from the axially outer facing surfaces 112 of the pistons. Each of the bosses 110 has an annular groove 114 defining an area of reduced diameter immediately adjacent the outer end surfaces 112. The groove is adapted to receive and retain a washer-shaped flexible seal element 116 which has a central opening therethrough which allows it to be received in and retained by the groove 114. The outer diameters of the seals 116 are slightly less that the outside diameter of the piston with which they are associated. The seals 116 are adapted to overlay the plurality of bypass openings 108 and serve to prevent refrigerant flow into the bypass openings when refrigerant is flowing in a direction towards the outer axial ends 112 of the respective pistons. The seals 116 are further configured such that they will move out of sealing relationship with the bypass openings 108 when refrigerant is flowing with respect to each piston in the direction opposite from that described above, to allow substantially unrestricted flow therethrough as will be understood as the description continues. In the preferred embodiment the seals 116 are made from a synthetic resin such as teflon.

Turning back to the refrigerant metering rod 74, as best seen in FIG. 4, the previously referred to enlarged end portion 90 of the rod 74 defines an enlarged annular planar surface 120, facing to the right as viewed in the drawing figures. This surface 120 and a smaller diameter portion of the rod adjacent thereto serve to receive and support a cooling piston metering rod seal 122. The seal 122 is made from a material which will swell or otherwise seal when exposed to a refrigerant, a neoprene O-ring has performed satisfactorily in practice. The enlarged end 90 and O-ring 122 carried thereby serve as a stop for limiting the motion of the cooling piston 92 to the left. Further, the O-ring seal 120 is adapted to engage the end of the boss 110 on the cooling piston 92 to establish a fluid tight seal therebetween when the piston is urged into contact with the O-ring.

A refrigerant metering spring 124, comprising a helically wound spring is disposed within the expansion valve body 42, 44 in coaxial relationship with the refrigerant metering rod 74. The ends of the spring 124 engage the inner axial ends 126 of each of the metering pistons 92 and 98. In the preferred embodiment, the spring 124 is partially compressed between the two pistons to preload the refrigerant metering assembly. This preloading is accomplished by proper selection of the components such that upon threading of the metering rod retainer 66 onto the threaded end 76, of the metering rod 74, the spring is compressed to a desired level of preload.

As previously discussed in connection with FIG. 1, an assembled dual flow variable area expansion valve 12 is installed in the refrigerant line 40 extending between the indoor coil 22 and the outdoor coil 28 of a heat pump. As shown, the expansion device 12 is positioned in the outdoor heat exchanger assembly 18 close to the outdoor coil 28. The orientation of the device, as shown in FIG. 1, is actually the reverse from that shown in the other drawing figures. As will be understood, variable area flow metering passage 102 will serve as the heating expansion orifice (with flow from right to left) as viewed in FIGS. 2–7. Similarly the variable area flow metering passage 96 will serve as the cooling orifice (with flow from left to right) as viewed in FIGS. 2–7, during cooling operation of the system.

Referring now to FIG. 2, the dual flow variable area expansion valve 12 is shown in a static no-flow condition. The device will first be described during the heating mode of operation wherein the reversing valve 32 is positioned so that the system will operate in the heating mode with the indoor coil 22 functioning as a condensing coil and the outdoor coil 28 functioning as an evaporator.

As shown, the spring 124 has been pre-load (as described above) and, urges both the heating piston 98 and the cooling piston 92 into fluid tight engagement with the O-rings 80, and 122, respectively, carried by the refrigerant metering rod 74 (as also described above). As a result, no refrigerant may flow through either flow metering passage 102 or 96 until the preload is overcome. As a result of the above described positive shut-off feature of expansion device 12 is capable of preventing refrigerant migration therethrough when it is installed in a refrigeration system when the system is shut off. It also follows that the system is able to maintain a pressure differential between the high and low sides of the system when shut off. A direct benefit of this is that the Degradation Coefficient CD of the refrigeration system is reduced. The Degradation Coefficient is a term defined by the U. S. Department of Energy which relates to the measure of the efficiency loss of the system due to cycling of the system.

At the start of a heating mode cycle, the pressure differential across the heating piston 98 begins to develop, with the high side being to the right of the piston and the low side to the left thereof. As the pressure differential across the piston 98 develops, it urges the piston to the left against the force of the spring 124.

Figure 10:
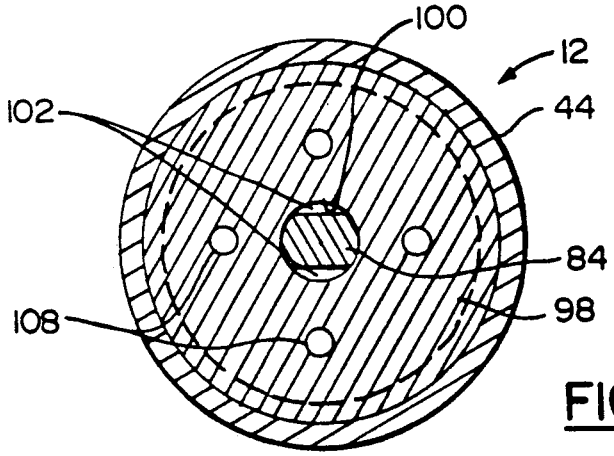
FIG. 10 is a sectional view of the first embodiment of the expansion device taken along the lines 10—10 of FIG. 3.

When the pressure differential exceeds the force exerted by the preload spring, i.e., the threshold pressure differential for the system is exceeded, refrigerant begins to flow through the heating mode variable area flow metering passage 102 defined between the heating configuration 84 of the rod 74 and the heating flow metering port 100. FIGS. 3 and 10 illustrate the valve 12 as it appears in heating operation with an intermediate pressure drop across the piston. With specific reference to FIG. 10 it will be noted that the variable area 102 is made up of several discreet segments, on opposite sides of the rod. These segments are defined by tapers forming the heating metering configuration 84 of the rod 74.

As a general rule, in controlling the flow of refrigerant in the heating mode of operation it has been found that the cross sectional area of the heating metering configuration 84 of the rod 74 should progress from a larger value, adjacent the O-ring seal 80, to a smaller valve as the left hand end of the heating configuration 84 is approached. The relationship thus established is that the heating flow metering passage 102 defined by the heating metering port 100 and the heating configuration 84 on the rod is small at low pressure differentials and increases as the pressure differential across the piston 98 increases.

When the system is in the heating mode of operation and the heating piston 98 is in the position illustrated in FIG. 3 it will be noted that the cooling piston 94 is urged against the stop defined by the enlarged end 90 of the metering rod. It will be further noted that the bypass opening seal 116 on the cooling piston has moved away from the outer end 112 of the cooling piston thereby allowing an unrestricted flow of refrigerant through the plurality of bypass openings 108 in the cooling piston during the time when the heating piston is actively metering. It should accordingly be appreciated that the operation of the dual flow variable area expansion valve 12 allows the device to control the cross sectional area of the heating variable area flow metering passage 102 as a function of the pressure differential across the piston 98.

Figure 11:
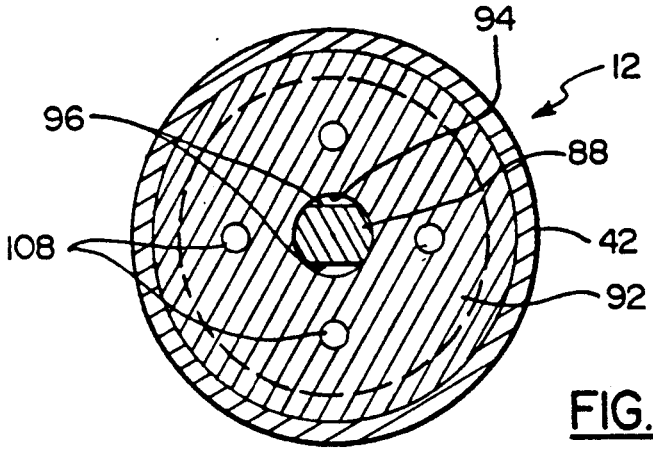
FIG. 11 is a sectional view of the first embodiment of the expansion device taken along the lines 11—11 of FIG. 4.

To operate the heat pump system 10 in the cooling mode of operation, the setting of the reversing valve 32 is changed. As a result, hot gaseous refrigerant is discharged from the compressor 14 to the reversing valve 32 which directs the hot gaseous refrigerant to the outdoor coil 28 which is now operating as a condenser and rejecting heat removed from the indoor space to the ambient outside air. From the outdoor condenser 28 the refrigerant is passed through the dual flow variable area expansion device 12 and thence through the longer run of refrigerant line 40 to the indoor coil 22 which now serve as an evaporator. FIGS. 4 and 11 illustrate the expansion device 12 as it appears in cooling operation with an intermediate pressure drop across the cooling piston 94. With specific reference to FIG. 11, it will be noted that the variable area flow metering passage 96 is made up of several discreet segments on opposite sides of the rod. These segments are defined by tapers forming the cooling configuration 88, on the rod 74.

As a general rule, in controlling the flow of refrigerant in the cooling mode of operation, it has been found that the cross sectional area of the metering configuration 88 should progress, from a smaller value adjacent the enlarged end 90, to a larger area as the right hand end of the cooling configuration of the rod is approached. The relationship thus established is that the flow metering passage, defined by the cooling flow metering port 94 and the cooling configuration 88, is larger at low pressure differentials and decrease as the pressure differential across the piston 92 increases.

As described above in connection with the heating embodiment, when the cooling piston 92 is the active, i.e. metering piston, the heating piston 98 is in its extreme right hand position and the metering bypass openings 108 in the heating piston are uncovered by the heating piston seal 116 to allow unrestricted refrigerant flow therethrough. It should accordingly be appreciated that the operation of the dual flow variable area expansion device 12, as described above, allows the device to control the cross-sectional area of the cooling variable area flow metering passage 96 as a function of the pressure differential across the piston 92.

By performing a pressure balance analysis on the pistons 92 and 98, a designer is able to customize the geometry of the rod configurations 84, 88 and other system parameters such that it is capable of controlling the flow of refrigerant in a heat pump system, at optimum conditions over a wide range of operating conditions.

When the expansion device 12 is in operation in a system, the position of the active piston, i.e., the piston which is currently metering, with respect to the refrigerant metering rod may be determined by analyzing the force acting on the opposite sides of the active piston. The following equation sets forth these forces: $F=PA=K\ x$. In the foregoing equation, the variables and constants are defined as follows:

P = condensing pressure (high side)—evaporating pressure (low side)

A = the area of the piston

K = the spring rate x = piston travel

Using the above equation, along with well known refrigeration design techniques, a design engineer is able to design an expansion device 12 which is capable of controlling the flow of refrigerant in a heat pump system, in both the heating and cooling modes of operation, over a wide range of conditions.

In the dual flow variable area expansion valve 12 described above the heating mode piston 98 is substantially larger than the cooling mode piston 92. With reference to the above equations it will be appreciated that the piston area enters directly into the force balance analysis. The larger piston area for heating operation compensates for the pressure differentials experienced during the normal range of heating operation which are considerably smaller than those for the cooling mode of operation. As a result, a heating piston of the same size as a cooling piston would result in piston positions along the metering rod which would be very close to one another. By increasing the heating piston area, the distances, x, i.e., the distances along the heating configuration portion of the rod are made substantially greater. As a result, better control over the expansion device during the heating mode of operation is obtained.

Figure 5:
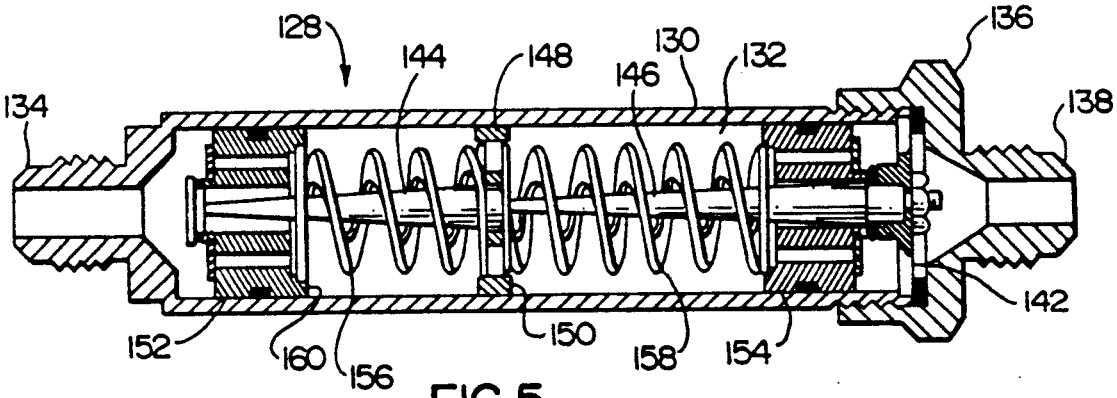
FIG. 5 is a longitudinal sectional view through an expansion device according to another embodiment of the present invention.
Figure 6:
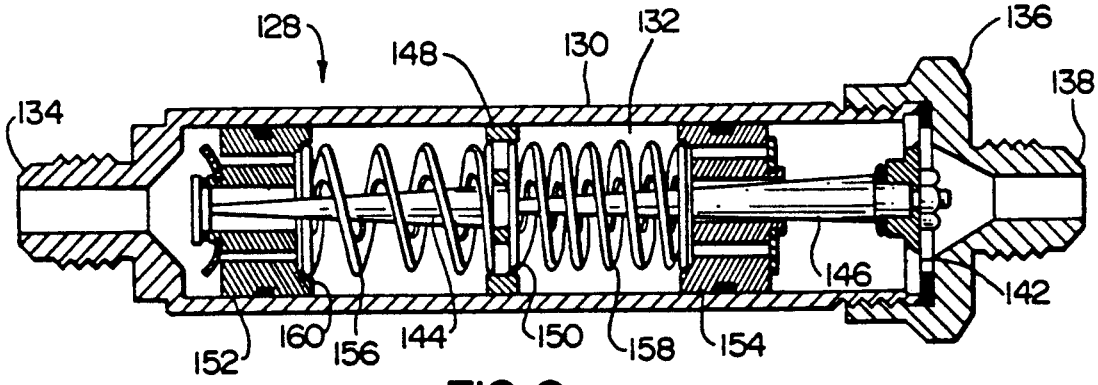
FIG. 6 is a longitudinal sectional view of the expansion device of FIG. 5 showing operation of the device while in the heating mode of operation.
Figure 7:
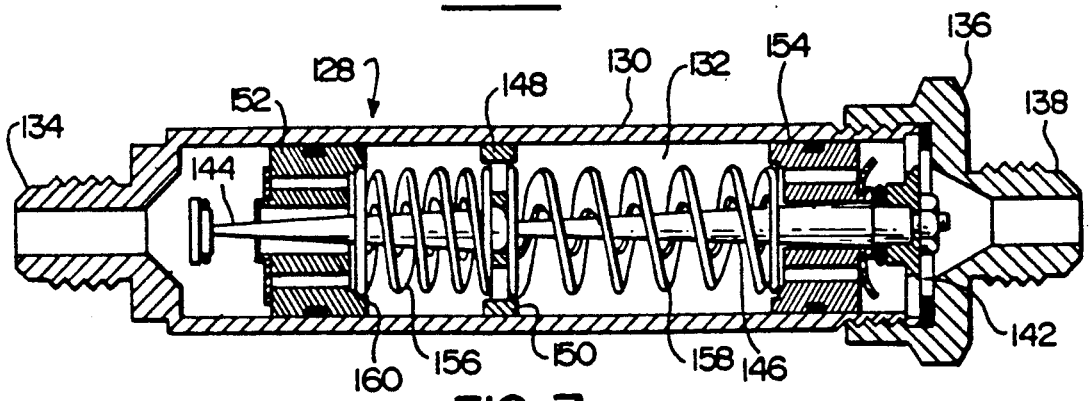
FIG. 7 is a longitudinal sectional view of the expansion device of FIG. 5 showing operation of the device while in the cooling mode of operation.

Looking now to FIGS. 5, 6 and 7 a second embodiment 128 of the dual flow variable area expansion valve is shown. The valve 128 includes a substantially cylindrical body 130 having a uniform diameter which defines an interior chamber therein 132 also of a uniform diameter throughout its length. Valve 128 includes a left hand nipple 134, and an end cap 136, also including a nipple 138, closing the right hand end. The configuration of the nipples 134, 138 and the end cap 136 are substantially the same as those described hereinabove in connection with the first embodiment of the valve 12 and will not be described in more detail herein.

Figure 8:
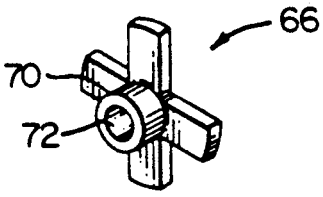
FIG. 8 is a perspective showing of the refrigerant metering assembly retaining spacer of both embodiments of the invention.
Figure 9:
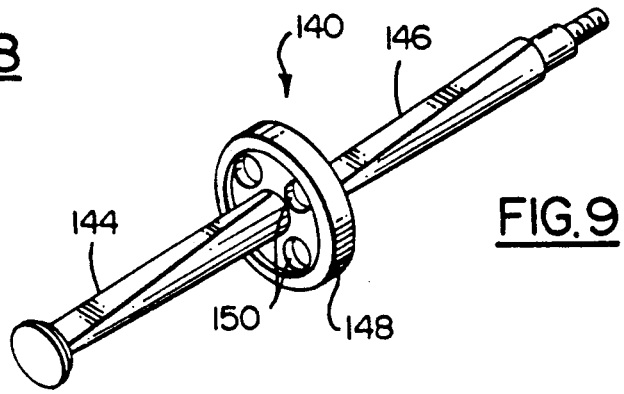
FIG. 9 is a perspective showing of the refrigerant metering rod of the expansion device of FIG. 5.

As with the first described embodiment the expansion valve 128 comprises a refrigerant metering rod 140 which is mounted in a cantilever fashion by a metering rod retainer 142 in a manner identical to that in the first described embodiment. The metering rod retainer 142 is identical to the retainer 66 shown in FIG. 8 except it is of smaller size consistent with the smaller size of the housing to which it is attached. The refrigerant metering rod is shown in detail in FIG. 9 and differs in several respects from that of the first described embodiment.

The right hand end of the metering rod 140 includes a threaded portion and an O-ring supporting portion which are identical to that described in connection with the metering rod 74. Likewise the left hand end of the metering rod 140 includes an enlarged end portion and O-ring carried thereby, which are identical to that described in connection with the metering rod 74. The cooling configuration of the metering rod 140 bears reference numeral 144 and is substantially identical to the cooling configuration of the rod 74. The heating configuration 146 of the metering rod 140 is substantially longer than that of the first described embodiment. Also, the region of maximum diameter of the cooling configuration 144 and the region of minimum diameter of heating configuration 146 are separated by a permanently affixed structural disk like element 148 which serves to assist in supporting the rod 140 within the body 130 and which is provided with a plurality of flow openings 150 therethrough which will offer no resistance to refrigerant flow therethrough in either direction.

Mounted on the cooling configuration 144 and the heating configuration 146 of the metering rod 140 are a cooling piston 152 and a heating piston 154 respectively. Each of the pistons 152 and 154 includes a flow metering port extending centrally axially therethrough which cooperates with the portion of the metering rod which surrounds to define a variable area flow metering passage therebetween. Other features of the pistons are identical to those described above in connection with the previous embodiment in reference should be made to that description for the details of these features of the pistons. In the present embodiment both pistons are of the same size, and, accordingly are identical to one another with the exception of their positions being reversed, left to right, within the valve body 130.

A first refrigerant metering spring 156, comprising a helically wound spring, is disposed within the expansion valve body in coaxial relationship with the cooling configuration 144 of the refrigerant metering rod 140. One end of the cooling spring 156 engages the inner axial end 160 of the cooling piston 152. The other end of the cooling spring 156 engages one side of the separating disk 148 of the metering rod 140. A second refrigerant metering spring 158 comprises a helically wound spring disposed coaxially around the heating configuration 146 of the metering rod 140 and and extends between the inner axial end of the heating piston 154 and the other side of the separating disk 148. The heating spring, because of the longer length of the heating configuration of the rod is substantially longer than the cooling spring 156. In the preferred embodiment, the springs 156 and 158 are partially compressed between the two pistons and the separating disk 148 to preload the refrigerant metering assembly. This preloading is accomplished as in the previous embodiment by threading of the metering rod retainer 142 on to the threaded end of the metering rod in order to partially compress the springs.

In the first embodiment 12 of the dual flow variable area expansion valve compensation for the smaller pressure differentials experienced during the heating range of operation was made by enlarging the piston area of the heating piston. In the present embodiment of the valve this compensation is made by elongating the heating metering configuration and by selecting a lower spring rate K for the heating metering spring 158 which allows for distances X on the heating configuration which will give good control over the expansion device during the heating mode of operation.

The operation of the device 128 is identical to that described above with respect to the first embodiment and no further description of operation of the device within a heat pump system will be given herein.

A substantial reduction in the amount of refrigerant charge required in a split system heat pump system may be realized by the use of a dual flow variable area expansion device such as that disclosed herein. Further significant cost advantages, due to the reduction in refrigerant charge required, may be realized by the elimination of an accumulator in the system.

A typical split system residential heat pump is designed with a substantially greater outdoor coil volume than indoor coil volume. This is done to maximize the cooling performance of the system, which is typically the major selling feature or purpose of a heat pump system. Because of the substantially larger outdoor coil volume, the circulated refrigerant charge is proportionately greater for cooling cycle operation than heating cycle operation. As a result of the necessity of using the higher charge quantity, heating operating modes are subject to flooding of the compressor which reduces the capacity and reliability of the system. Accumulators have necessarily been used in such systems to prevent the flow of liquid refrigerant through the suction line to the compressor.

The variable area expansion capability of the expansion valve of the present invention, in the cooling mode of operation, allows the device to adapt the expansion area to system operating conditions thereby optimizing values of sub-cooling and super heat. Tests conducted on a variable area expansion valve dedicated to cooling operation have shown that a 30 percent reduction in refrigerant system using a pair of fixed orifice expansion devices, i.e. one dedicated to cooling the other to heating. It follows, that such a reduction in charge is obtainable with the device of the present invention.

A further decrease in refrigerant charge may be realized by positioning the device at the outdoor coil instead of the indoor coil where a cooling expansion device is usually located. Such positioning means that the refrigerant line 40, during the cooling mode of operation, contains a 2-phase flow, instead of 100 percent liquid which it would contain if a conventional cooling expansion device were positioned in the liquid line immediately preceding the indoor (evaporator) coil. Less refrigerant is thus necessary to fill the line 40. Accordingly, it should be appreciated that a refrigerant expansion valve has been provided that meters the flow of refrigerant therethrough in one direction through a first orifice that varies in cross sectional area as a function of the pressure differential across the valve. The same expansion valve controls refrigerant flow in the other direction therethrough through a second orifice that varies in cross sectional area as a function of the pressure differential across the valve.

This invention may be practiced or embodied in still other ways without departing from the spirit or essential character thereof. The preferred embodiments described herein are therefor illustrative and not restrictive, the scope of the invention being indicated by the appended claims and all variations with come within the meaning of the claims are intended to be embraced therein.

What is claimed is:

1. A refrigerant expansion valve for use in a heat pump comprising;

a body having a flow passage therethrough for passing a flow of refrigerant in either direction;

means within said flow passage for metering the flow of refrigerant therethrough in one direction through a first orifice that varies in cross sectional area as a function of the pressure differential across said valve, and for allowing substantially unrestricted flow therethrough when refrigerant is flowing through said valve in the other direction;

means within said flow passage for metering the flow of refrigerant therethrough in said other direction through a second orifice, said second orifice increasing in cross sectional area as the pressure differential across said valve increases, and, for allowing substantially unrestricted flow therethrough when refrigerant is flowing through said valve in said one direction.

2. A refrigerant flow metering device comprising;

a body having a flow passage extending therethrough;

a first piston having a first flow metering port extending therethrough, said first piston being movably disposed within said flow passage adjacent one end of said body;

a second piston having a second flow metering port extending therethrough, said second piston being moveably disposed within said flow passage adjacent the other end of said body;

an elongated member extending through both said first flow metering port and said second flow metering port, said elongated member having; a first flow metering configuration thereon adapted to cooperate with said first flow metering port to define a first flow metering passage therebetween, the cross sectional area of said first flow metering passage varying in relation to the position of said first piston with respect to said first flow metering configuration; and a second flow metering configuration thereon adapted to cooperate with said second flow metering port to define a second flow metering passage therebetween, the cross sectional area of said second flow metering passage varying in relation to the position of said second piston with respect to said second flow metering configuration;

means for axially and radially supporting said elongated member within said body;

first stop means for engaging said first piston to limit movement of said first piston in the direction towards said one end of said body, and, for preventing the flow of refrigerant through said first flow metering passage when said first piston engages said first stop means;

second stop means for engaging said second piston to limit movement of said second piston in the direction towards said other end of said body, and, for preventing the flow of refrigerant through said second flow metering passage when said second piston engages said second stop means;

means for biasing said first and second pistons into engagement with said first and second stop means, respectively, and, for allowing movement of said first and second pistons away from said first and second stop means, respectively as a function of the differential pressure across said first and second pistons respectively;

said first piston further including, first bypass flow means for allowing substantially unrestricted flow through said first piston in the direction from said other end of said body to said one end thereof;

said second piston further including second bypass flow means for allowing substantially unrestricted flow through said second piston in the direction from said one end of said body to said other end thereof;

whereby when refrigerant flows through said device in a direction from said one end of said body to said other end thereof a pressure differential will be established across said first piston and said first piston will move away from said first stop means to thereby meter refrigerant through said first flow metering passage, and, said second bypass flow means will allow unrestricted flow through said second piston;

and, further, whereby when refrigerant flows through said device in the direction from said other end to said one end of said body a pressure differential will be established across said second piston which causes said second piston to move out of engagement with said second stop means thereby metering refrigerant through said second flow metering passage and said first bypass flow means will allow unrestricted flow through said first piston.

3. The apparatus of claim 2 wherein said means for biasing comprises a coil spring coaxially mounted about said elongated member, one end of said spring engaging the axial inner end of one of said pistons, and, the other end of said spring engaging the axial inner end of the other of said pistons.

4. The apparatus of claim 3 wherein said second piston has a cross sectional area larger than the cross sectional area of said first piston.

5. The apparatus of claim 2 wherein said means for biasing comprises;

a spring support means, affixed to said elongated rod at a location therealong intermediate said first and second flow metering configurations;

a first coil spring mounted on said elongated member in surrounding relationship with said first flow metering configuration, and, extending between one side of said spring support means and said first piston; and, a second coil spring mounted on said elongated member in surrounding relationship with said second flow metering configuration, and, extending between the other side of said spring support means and said second piston.

6. The apparatus of claim 5 wherein the spring rate of said first spring is lower than the spring rate of said second spring.

7. A refrigerant expansion valve for use in a heat pump comprising:

a body having a flow passage therethrough for passing a flow of refrigerant in either direction;

means within said flow passage for metering the flow of refrigerant therethrough in one direction through a first orifice, said first orifice decreasing in cross sectional area as the pressure differential across said valve increases, and, for allowing substantially unrestricted flow therethrough when refrigerant is flowing through said valve in the other direction;

means within said flow passage for metering the flow of refrigerant therethrough in said other direction through a second orifice, said second orifice increasing in cross sectional area as the pressure differential across said valve increases, and, for allowing substantially unrestricted flow therethrough when refrigerant is flowing through said valve in said one direction.

* * * * *